US005722176A

United States Patent [19]

Hinson

[11] Patent Number: 5,722,176

[45] Date of Patent: Mar. 3, 1998

[54] BRICK ALIGNMENT APPARATUS

[76] Inventor: Wayne Hinson, Rte. 1, Jefferson, S.C. 29718

[21] Appl. No.: 640,188

[22] Filed: Apr. 30, 1996

[51] Int. Cl.[6] ..... E04G 21/18

[52] U.S. Cl. ..... 33/518; 33/406; 33/408; 33/533; 33/645

[58] Field of Search ..... 33/518, 404, 406, 33/407, 408, 533, 534, 645, 646, 647, 648, 649

[56] References Cited

U.S. PATENT DOCUMENTS

| | | | |
|---|---|---|---|
| 1,410,481 | 3/1922 | Landon . | |
| 1,880,261 | 10/1932 | Larsen . | |
| 2,685,741 | 8/1954 | Lilkinson . | |
| 2,715,777 | 8/1955 | Taylor et al. | 3/404 |
| 2,924,021 | 2/1960 | Proett et al. | 33/518 |
| 3,114,975 | 12/1963 | Jones | 33/406 |
| 3,130,500 | 4/1964 | Bongiovanni | 33/406 |
| 3,368,286 | 2/1968 | Zenke | 33/518 |
| 4,144,649 | 3/1979 | Huston . | |
| 5,125,162 | 6/1992 | Prebeck . | |
| 5,125,814 | 6/1992 | Lester . | |
| 5,129,150 | 7/1992 | Sorensen . | |
| 5,223,272 | 6/1993 | Pringle . | |
| 5,392,523 | 2/1995 | Hurt . | |
| 5,537,805 | 7/1996 | Allman | 33/518 |

*Primary Examiner*—Christopher W. Fulton
*Attorney, Agent, or Firm*—Kennedy Covington Lobdell & Hickman, L.L.P.

[57] ABSTRACT

An apparatus for aligning bricks placed in a predetermined pattern during construction of a static structure, particularly a chimney, with the bricks being placed in an angular relationship with upstanding walls of the chimney, includes an assembly for attaching the apparatus to a preexisting vertically oriented wall portion of the chimney, with the attachment assembly being removably attachable to and extending parallel with the wall portion, an assembly for supporting bricks oriented in a predetermined angular relationship with the wall portion with the brick support assembly being disposed in an angular relationship with the wall portion and aligned for brick abutment thereagainst and an arrangement for connecting the brick support assembly to the attachment assembly with the brick support assembly projecting a predetermined distance away from the attachment assembly in a predetermined angular relationship therewith. The present invention allows proper alignment of rows of bricks forming a sloping portion of a chimney.

12 Claims, 3 Drawing Sheets

BRICK ALIGNMENT APPARATUS

BACKGROUND OF THE INVENTION

The present invention relates broadly to apparatus used in construction of static structures, i.e., buildings, for aligning brick walls and, more particularly, to an apparatus for aligning bricks being applied in a sloping manner as when constructing a chimney.

Brick chimneys are commonly used in residential and other construction to provide an insulated structure for a firebox open to the interior of the static structure with which the chimney is associated. Typically, a generally rectangular firebox will be encased by a generally rectangular brick wall, open to the interior of the building and projecting upwardly a predetermined distance. The firebox will usually be vented into a vertically oriented flue which is formed with an inner dimension that is somewhat smaller than the inner dimension of the firebox. This nozzle-like structure causes flue gases to leave the firebox with increased velocity. The flue is typically enclosed with a brick chimney wall projecting upwardly beyond the firebox enclosure. Cosmetically, the outer portion of a brick chimney typically includes a sloped portion in the region where the firebox converges into the flue. The sloped portion typically includes at least one row of bricks extending in a perpendicular relationship with the bricks forming the wall portion surrounding the flue. These bricks will typically have an overhanging portion of some length and are arrayed in a distinctive row along the upper surface of the wall surrounding the firebox. Accordingly, these bricks are in a highly visible position and can greatly enhance or detract from the overall appearance of the chimney, depending upon the precision of their placement. As may be expected, the endmost portions of the rectangular bricks which overhang the firebox surrounding brick wall should be in generally parallel alignment to present a neat appearance. Some rustic styles include irregularly shaped bricks and a generally haphazard manner of placement. Nevertheless, most brick installations include uniformly shaped bricks and any disruption of the alignment of the overhanging bricks results in an unsightly appearance. This phenomenon is especially evident when perfectly aligned bricks are viewed. The effect is startling in that such a precision brick alignment appears difficult to achieve.

According to the prior art, such an alignment actually is difficult to achieve. The prior art method involves laying bricks by a brick mason with alignment being accomplished by sight and judgment. Typically, such conditions do not give rise to perfectly aligned bricks. Therefore, the problem exists regarding the alignment of bricks along the sloping portion of a chimney in the region where the firebox surrounding wall tapers into the flue surrounding wall.

SUMMARY OF THE INVENTION

It is accordingly an object of the present invention to provide an apparatus for achieving precision alignment of bricks used for the sloping portion of a chimney.

It is further an object of the present invention to provide such an apparatus which is manually adjustable to achieve the desired overhang of the sloping bricks with respect to the vertical wall to which they are affixed.

To that end, an apparatus is provided for aligning bricks in a predetermined pattern during construction of a static structure with bricks being placed in an angular relationship with upstanding walls of the static structure. The brick alignment apparatus includes an assembly for attaching the apparatus to a preexisting vertically oriented wall portion of the static structure with the attachment apparatus being removably attachable to and extending in a generally parallel relationship with the wall portion; an assembly for supporting bricks oriented in a predetermined angular relationship with the wall portion against gravitationally induced movement with the brick support assembly including a brick support member and a brick support surface attached thereto with the brick support surface being disposed in an angular relationship with the wall portion and aligned for brick abutment thereagainst. The present invention further includes an arrangement for connecting the brick support assembly to the attachment assembly with the brick support assembly projecting a predetermined distance away from the attachment assembly in a predetermined angular relationship therewith.

It is preferred that the attachment assembly include a generally flat member having a plurality of openings formed therein with the flat member being removably attachable to the wall portion using removable fasteners in cooperation with the openings.

It is further preferred that the connecting arrangement include at least one generally elongate arm fixed to the attachment assembly at a predetermined angular relation therewith and projecting the predetermined distance outwardly therefrom. The connecting arrangement further preferably includes a mounting plate extending in a cantilevered manner from the connecting member for support of the brick support member thereon. It is preferred that the connecting arm and the mounting plate be disposed at right angles to one another.

Preferably, the brick support member is slidably mounted at the mounting plate and is selectively positionable and fixable in a selected position. At least one of the mounting plate and the brick support member should include at least one slot extending longitudinally with respect to the brick support member. The mounting plate and the brick support member are attached to one another with at least one nut and bolt assembly. Preferably, the brick support surface and the brick support member are disposed at right angles to one another with the brick support member being configured to extend colinearly with sloping bricks in abutment with the brick support surface when the apparatus is attached to a wall portion using the attachment assembly.

By the above, the present invention provides an apparatus for aligning bricks placed in a predetermined pattern on a sloping portion of a chimney during construction thereof with bricks being placed in an angular relationship with upstanding walls of the chimney. The apparatus is simple, easy to use and provides a brick mason with the ability to produce superior chimney work which is striking in appearance.

The present invention further includes a method for aligning bricks placed in a predetermined pattern during construction of the chimney or other static structure with the bricks being placed in an angular relationship with upstanding walls of the structure. The method includes providing an apparatus as above described, attaching the attachment assembly to the preexisting wall portion with the connecting arrangement projecting outwardly therefrom; adjusting the position of the brick support member to reside at a position with respect to the wall portion characterized by the brick support surface being disposed a predetermined displacement from the wall portion and being disposed in a predetermined angular relationship therewith; fixing the brick support member at the position; and applying the bricks to the wall portion with the endmost portions of the bricks being in abutment with the brick support surface and in parallel alignment one another with a lengthwise dimension of the bricks extending generally perpendicularly to the wall portion.

It is further preferred that the step of positioning the brick support member includes sliding the brick support member along the mounting plate until a selected position is reached. Further, the step of fixing the brick support member in position includes the step of tightening the nut and bolt assembly sufficiently to prevent relative movement between the mounting plate and the brick support member.

By the above, the present invention provides a method for using the above-described apparatus to simply and effectively place bricks in precision alignment in a relatively quick and efficient manner.

DETAILED DESCRIPTION OF THE PREFERRED EMBODIMENTS

Figure 1:
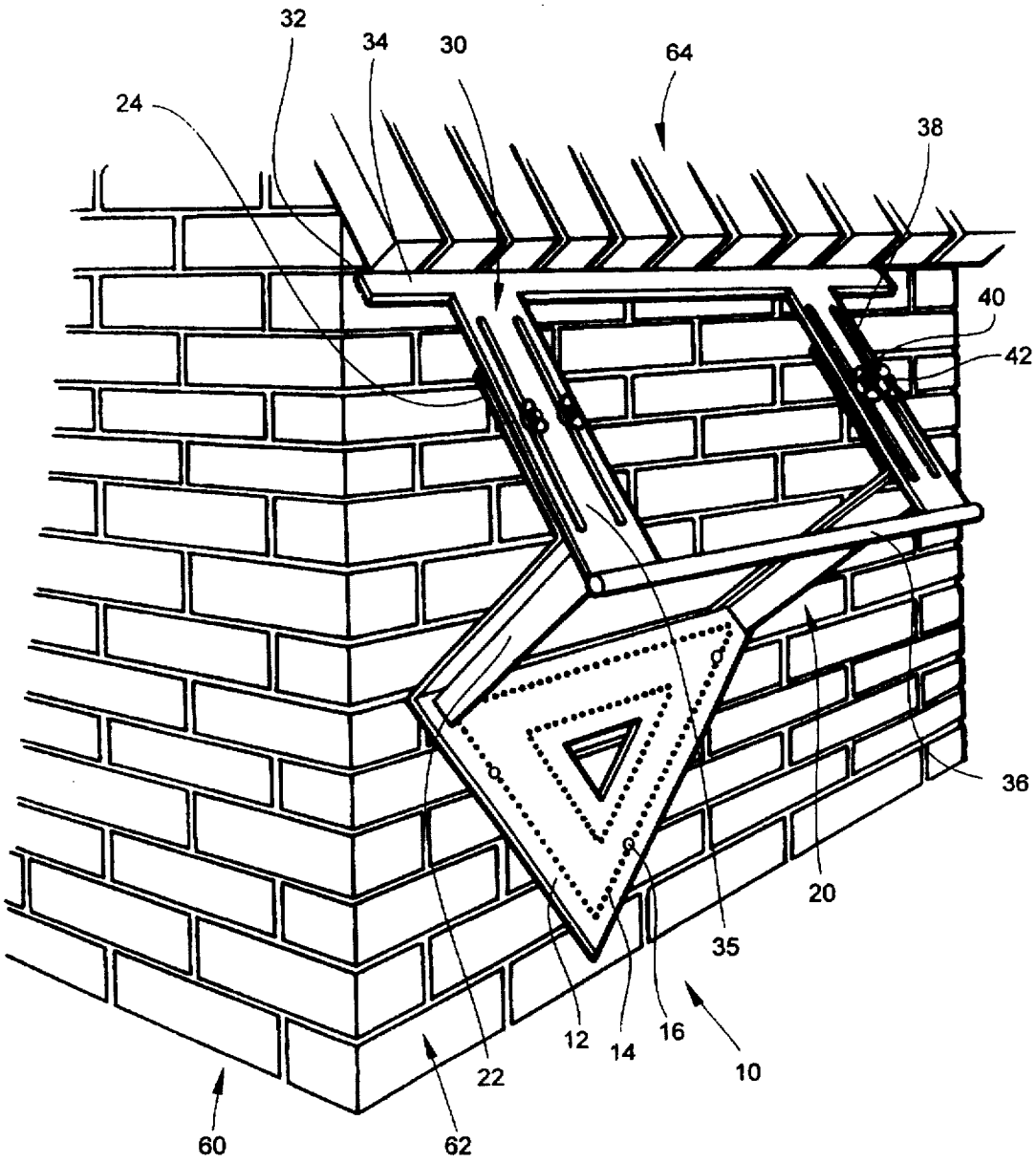
FIG. 1 is a perspective view of an apparatus for aligning bricks according to the preferred embodiment of the present invention showing the sloping bricks at a first predetermined displacement from the vertical wall.
Figure 2:
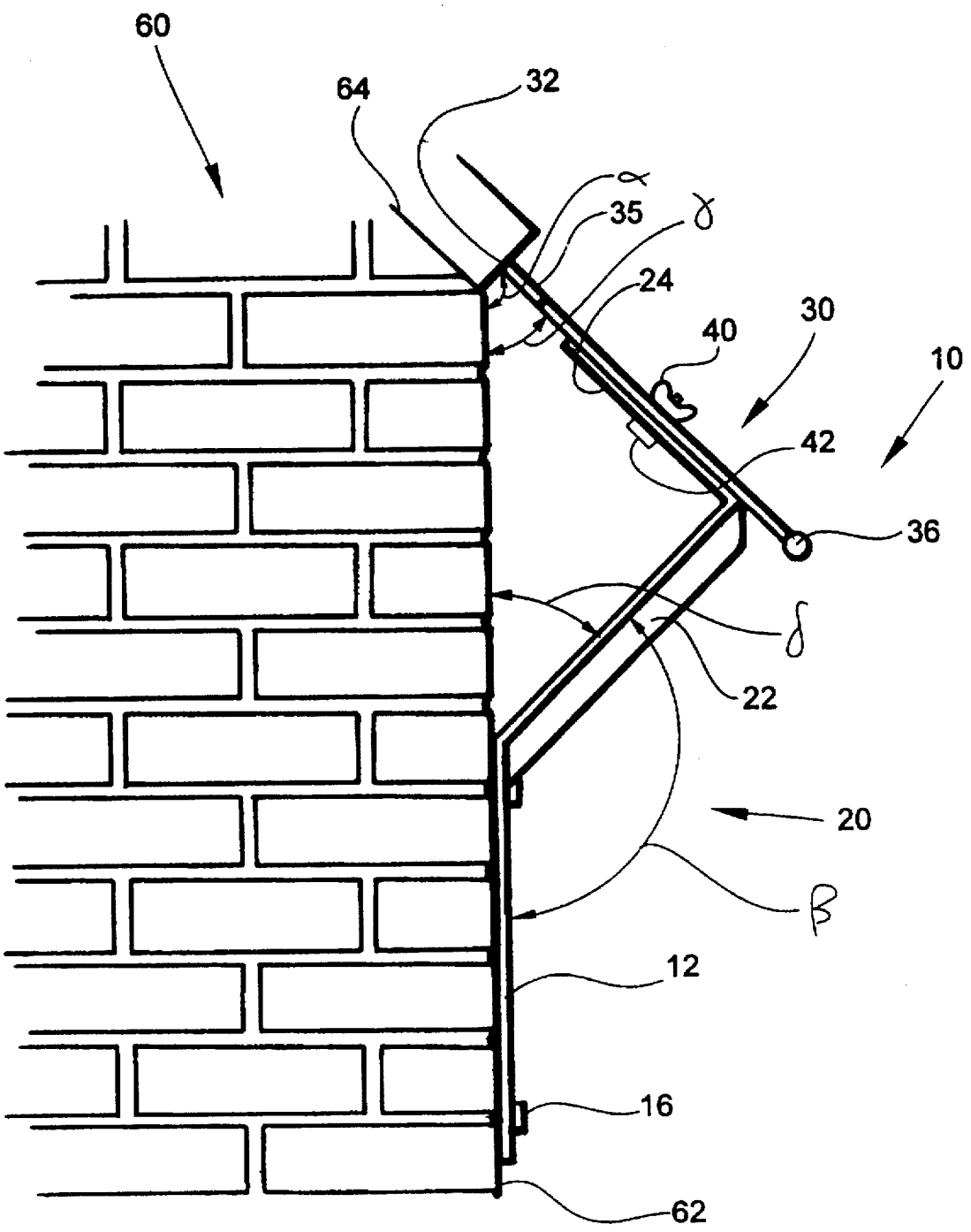
FIG. 2 is a side view of the apparatus attached to a wall illustrating the bricks at a second, optional displacement from the vertical wall.
Figure 3:
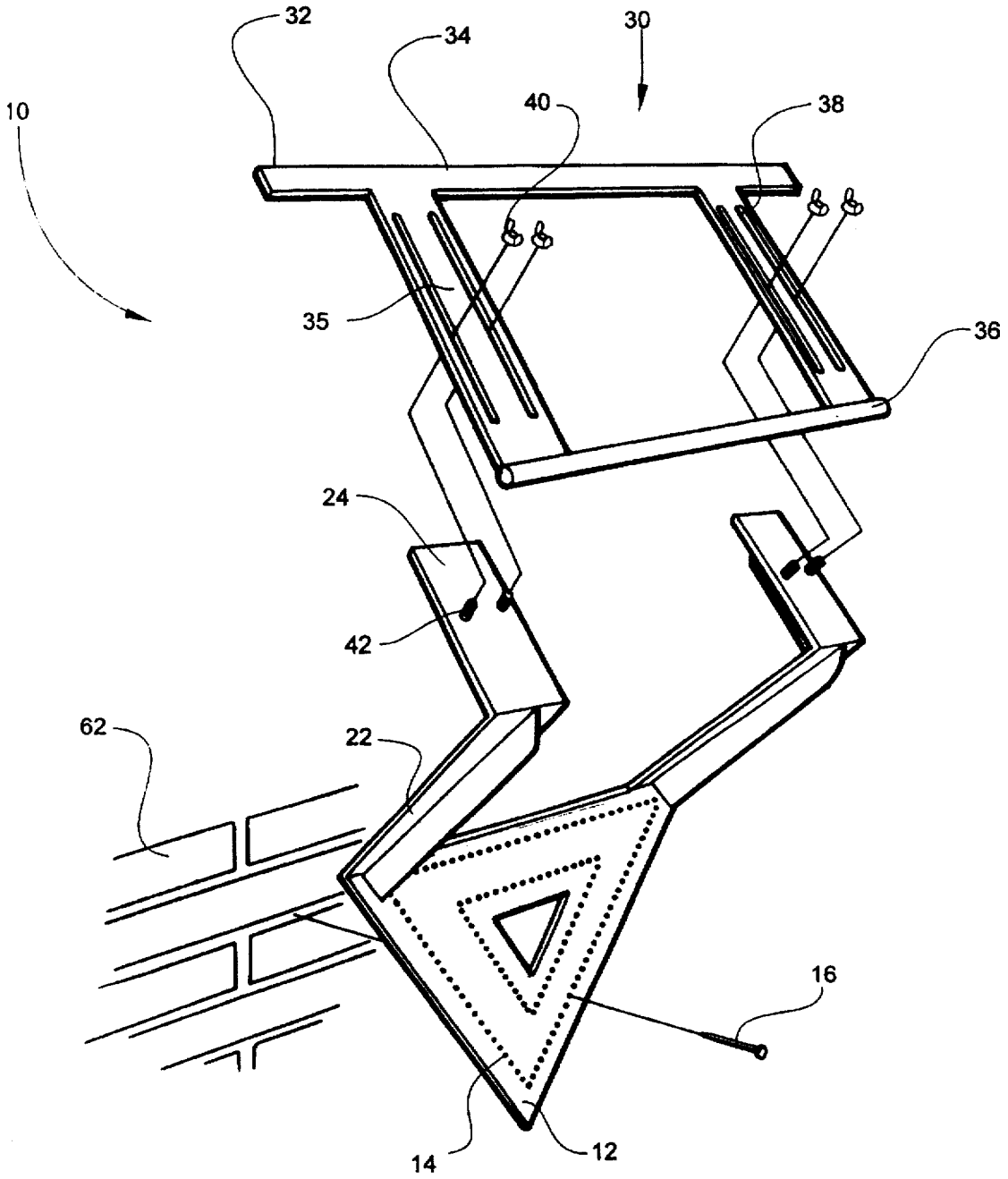
FIG. 3 is an exploded view of the apparatus illustrated in FIG. 1.

Turning now to the drawings and, more particularly, to FIG. 1, an apparatus for aligning bricks placed in a predetermined pattern during construction of a static structure, particularly a chimney, is illustrated generally at 10 and includes an attachment member 12 having a plurality of openings 14 formed therein, a connecting arrangement 20 including a pair of projecting arms 22 extending outwardly from the attachment member 12 and a brick support assembly 30 attached to the connecting arrangement 20. In FIG. 1, the apparatus 10 is illustrated during use and, accordingly, is shown removably affixed to a static structure, namely, a vertically oriented upstanding brick wall. FIG. 3 illustrates the apparatus in an exploded manner. It should also be noted that the adjustment feature of the present invention, which will be explained in greater detail hereinafter, allows the positioning of bricks at a selected displacement from the vertically oriented wall. A first displacement is illustrated in FIG. 1 and a second displacement is illustrated in FIG. 2.

The attachment member 12 is formed as a triangular member, preferably formed from steel and includes a series of triangularly arranged openings formed therein. FIG. 1 illustrates the arrangement as a series of nested triangles, yet it should be noted that any arrangement of openings may be used so long as the openings are sufficient in size and position to retain the attachment member 12 to a wall, illustrated at 62 in FIG. 1. The inverted triangular nature of the attachment member 12 allows for more precision alignment of the assembly 10 when mounted to the vertical wall 62. By placing the point of the triangular member 12 downwardly, a conventional plumb bob (not shown) can be used to position the apparatus 10. Optionally, a level may be used across the top, flat portion of the attachment member 12. It should be noted that other methods of aligning the apparatus 10 will be apparent to those skilled in the art of brick masonry.

The connecting arrangement is formed as two parallelly oriented steel arm portions 22 formed as generally planar members having a perpendicularly oriented brace portion extending outwardly from one side thereof, creating an arm having a T-shaped cross section. The connecting arms 22 are mounted to the attachment member 12 in a predetermined angular relationship therewith. Since the attachment member 12 is fixed to the existing wall 62 in a generally parallel manner, the angle $\beta$ existing between the attachment plate 12 and the connecting arms 22 also defines the angular relationship between the connecting arms 22 and the vertical wall 62. The angle, $\delta$, between the connecting arms 22 and the vertical wall 62 is defined as 180° minus $\beta$. This relationship is best seen in FIG. 2.

The connecting assembly 20 also includes two mounting plates 24 formed as planar members which extend from the connecting arms 22 at right angles therewith. The mounting plates 24 extend away from the connecting arms 22 in a direction toward the wall portion 62 as seen in FIGS. 2 and 3. A plurality of bolts 42 are fixed to the mounting plates 24 to extend outwardly therefrom for interaction with nuts 40, particularly wing nuts, which will be explained in greater detail hereinafter.

The brick support assembly 30 is best seen in FIG. 3 and consists of a cylindrical handle portion 36 having two mounting bars projecting outwardly therefrom. The mounting bars are typically flat steel members joined at one end by the handle portion 36 and at opposite ends by a cross bar 34 which is formed integrally therewith and is also a flat steel member. The cross bar 32 in cooperation with the mounting bars 35 and the handle 36 form a generally rectangular open structure which is substantially flat when viewed from the side as seen in FIG. 2. Referring back to FIG. 3, a brick abutment surface 32 is formed on a longitudinal side of the cross bar 34 for brick abutment thereagainst. The mounting bars 35 are formed with pairs of elongate slots 38 extending along the length thereof. The slots are for passage of the bolts 42 associated with the mounting plates 24. Nuts, preferably wing nuts 40, are threadably attachable to the bolts 42 to retain the brick support assembly at a predetermined fixed position while bricks are applied to the static structure. As can be seen, the brick support assembly 30 extends generally parallelly with the mounting plates 24. With the bolts 42 in registry with the slots 38, the brick support assembly may be slidably moved along the mounting plates to a selected position for brick alignment, whereupon the wing nuts 40 are tightened to retain the brick support assembly 30 in place.

Referring now to FIG. 2, it can be seen that the brick abutment surface 32 is normal to the general orientation of the brick support member 30. Further, since the brick support member 30 extends parallelly with the mounting plates 24 which are at right angles with the connecting arms 22, the brick support member 30 is placed in a predetermined angular relationship with the wall 62. This angle $\gamma$ extending between the wall 62 and the brick support member 30 is defined as 90°-$\delta$. Further, since the brick support member 30 extends parallelly with the mounting plates 24 which are at right angles to the connecting arms 22, and since the brick support surface 32 is at a right angle with the brick support member 30, the brick support surface 32 extends parallelly with the connecting arms 22. Therefore the angle formed from the vertically oriented brick portions and the sloping brick portions, namely $\alpha$, equals the angle between the connecting arms 22 and the attachment member 12, namely $\beta$. Therefore, as seen in FIG. 2, the angle between the bricks, $\alpha$, is equal to the angle $\beta$ between the attachment member 12 and the connecting arms 22.

In operation, and according to the method of the present invention, in order to apply bricks in a precision arrangement to a sloping portion of a chimney, the attachment plate 12 is fixed to the wall portion 62 of the static structure 60 using masonry nails 16 in registry with the openings 14 formed in the attachment plates 12 and driven into the brick wall 62. It will be apparent to those skilled in the art that other methods may be used to attach the attachment member 12 to the wall portion 62 with equally satisfactory effect. Optionally, a shim (not shown) may be applied intermediate the wall 62 and the attachment member 12 to enhance the ability of the brick mason to position the device or to protect the wall 62 from the attachment member 12.

Once the attachment member is fixed to the wall, the wing nuts 40 are loosened and, using the handle 36, the brick support member 30 is slidably positioned with respect to the wall 62 at a desired position, depending on the desired overhang, or displacement of the sloping bricks 64 from the vertical wall 62. It should also be noted that the height of the entire assembly 10 from the ground is particularly important to observe and regulate so that the sloping bricks abut the brick support surface 32 at the desired position. As seen in FIG. 1, the sloping bricks 64 have a substantial overhang and, therefore, displacement from the vertical wall 62, while the bricks of FIG. 2 experience no overhang at all, indicating that the brick support surface 32 is closer to the vertical wall 62 in FIG. 2 than in FIG. 1.

Once the brick support assembly 30 has been positioned, the wing nuts 40 are tightened onto the bolts 42, thereby locking the brick support surface 32 in a position for brick application. As seen in FIG. 1, the bricks are placed against the vertical wall with the brick support surface 32 maintaining the bricks at a precise, common displacement from the vertical wall 62. The bricks are then laid in a conventional manner using masonry and allowed to set up. Once the bricks are in place and are held against movement, the apparatus 10 may be disassembled from the structure 60 and the fasteners 16 removed from the vertical wall 62. Removal of the apparatus 19, and subsequent patching of the holes caused by the fasteners 16, will result in a chimney of profound visual effect. The perfect alignment of the sloping bricks resulting from use of the apparatus according to the method of the present invention appears in stark contrast to bricks disposed according to visual perception only. The advantages provided to the brick mason by the present invention include the ability to provide a chimney of exacting dimension and neat appearance. The device is simple, inexpensive and easy to use.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An apparatus for aligning bricks placed in a predetermined pattern during construction of a static structure, the bricks being placed in an angular relationship with upstanding walls of the static structure, said brick alignment apparatus comprising:

means for attaching said apparatus to a preexisting vertically oriented wall portion of the static structure, said attachment means being removably attachable to and extending in a generally parallel relationship with the wall portion;

means for supporting bricks oriented in a predetermined angular relationship with the wall portion, said brick support means including a brick support member and a brick support surface attached thereto, said brick support surface being disposed in an angular relationship with the wall portion and aligned for brick abutment thereagainst; and means for connecting said brick support means to said attachment means with said brick support means projecting a predetermined distance away from said attachment means in a predetermined angular relationship therewith, said connecting means including one generally elongate arm fixed to said attachment means at said predetermined angular relation therewith and projecting said predetermined distance outwardly therefrom; and a counting plate extending in a cantilevered manner from said connecting member for support of said brick support member thereon, with said brick support member being slidably mounted to said mounting plate and selectively positionable and fixable in a selected position.

2. An apparatus for aligning bricks according to claim 1 wherein said attachment means includes a generally flat member having a plurality of openings formed therein and said flat member is removably attachable to the wall portion using removable fasteners in cooperation with said openings.

3. An apparatus for aligning bricks according to claim 1 wherein said connecting arm and said mounting plate are disposed at right angles to one another.

4. An apparatus for aligning bricks according to claim 1 wherein at least one of said mounting plate and said brick support member includes at least one slot extending longitudinally with respect to said brick support member, and said mounting plate and said brick support member are attached to one another with at least one nut and bolt assembly.

5. An apparatus for aligning bricks according to claim 1 wherein said brick support surface and said brick support member are disposed at right angles to one another.

6. An apparatus for aligning bricks according to claim 5 wherein said brick support member is configured to extend collinearly with sloping bricks in abutment with said brick support surface when said apparatus is attached to a wall portion using said attachment means.

7. An apparatus for aligning bricks placed in a predetermined pattern on a sloping portion of a chimney during construction thereof, the bricks being placed in an angular relationship with upstanding walls of the chimney, said brick alignment apparatus comprising:

means for attaching said apparatus to a preexisting vertically oriented wall portion of the static structure, said attachment means including a generally flat member having a plurality of openings formed therein and said flat member is removably attachable to said wall portion using removable fasteners in cooperation with said openings, said flat member extending in a generally parallel relationship with the wall portion;

means for supporting bricks oriented in a predetermined angular relationship with the wall portion against gravitationally induced movement, said brick support means including a brick support member and a brick support surface, said brick support surface being disposed in an angular relationship with said wall portion and aligned for brick abutment thereagainst and with said brick support member being slidably mounted to said mounting plate and selectively positionable and fixable in a selected position; and means for connecting said brick support means to said attachment means including at least one generally elongate arm fixed to said attachment means in a predetermined angular relation therewith and projecting a predetermined distance outwardly therefrom, and a mounting plate extending in a cantilevered manner with said connecting member for supporting said brick support member thereon with said brick support member projecting a predetermined distance away from said attachment means in a predetermined angular relationship therewith.

8. An apparatus for aligning bricks according to claim 7 wherein at least one of said mounting plate and said brick support member includes at least one slot extending longitudinally with respect to said brick support member, and said mounting plate and said brick support member are attached to one another with at least one nut and bolt assembly.

9. An apparatus for aligning bricks according to claim 7 wherein said connecting arm and said mounting plate are disposed at right angles to one another.

10. An apparatus for aligning bricks according to claim 7 wherein said brick support surface and said brick support member are disposed at right angles to one another.

11. A method for aligning bricks placed in a predetermined pattern during construction of a static structure, the bricks being placed in an angular relationship with upstanding walls of the static structure, said method comprising the steps of:

providing means for attaching said apparatus to a preexisting vertically oriented wall portion of the static structure, said attachment means being removably attachable to and extending in a generally parallel relationship with the wall portion;

providing means for supporting bricks oriented in a predetermined angular relationship with the wall portion against gravitationally induced movement, said brick support means including a brick support member and a brick support surface, said brick support surface being disposed in an angular relationship with the wall portion and aligned for brick abutment thereagainst with said brick support member being slidably mounted to said mounting plate and selectively positionable and fixable in a selected position;

providing means for connecting said brick support means to said attachment means with said brick support means projecting a predetermined distance away from said attachment means in a predetermined angular relationship therewith;

attaching said attachment means to the preexisting wall portion with said connecting means projecting outwardly therefrom, sliding said brick support member along said mounting plate to reside at a position with respect to the wall portion characterized by said brick support surface being disposed a predetermined displacement from the wall portion and being disposed in a predetermined angular relationship therewith;

fixing said brick support member at said position; and applying bricks to the wall portion, with endmost portions of the bricks being in abutment with said brick support surface and in parallel alignment with one another.

12. An apparatus for aligning according to claim 11 wherein at least one of said steps of providing a mounting plate and providing a brick support member includes providing at least one of said mounting plate and said brick support member having at least one slot extending longitudinally with respect to said brick support member, and said mounting plate and said brick support member are attached to one another with at least one nut and bolt assembly, and said step of fixing said brick support member in position includes said step of tightening said nut and bolt assembly sufficiently to prevent relative movement between said mounting plate and said brick support member.

* * * * *